US007460087B2

(12) United States Patent
Kim et al.

(10) Patent No.: US 7,460,087 B2
(45) Date of Patent: Dec. 2, 2008

(54) PLASMA DISPLAY PANEL AND DRIVE METHOD THEREOF

(75) Inventors: Tae Hyung Kim, Seoul (KR); Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 839 days.

(21) Appl. No.: 10/817,905

(22) Filed: Apr. 6, 2004

(65) Prior Publication Data

US 2004/0212562 A1 Oct. 28, 2004

(30) Foreign Application Priority Data

Apr. 7, 2003 (KR) ..... 10-2003-0021630

(51) Int. Cl.
*G09G 3/20* (2006.01)

(52) U.S. Cl. ..... 345/60; 345/63; 345/67; 345/68

(58) Field of Classification Search ..... 345/60, 345/63, 67–68
See application file for complete search history.

(56) References Cited

U.S. PATENT DOCUMENTS

| | | | | |
|---|---|---|---|---|
| 6,670,779 | B2 * | 12/2003 | Shen | 315/291 |
| 2002/0186184 | A1 | 12/2002 | Lim | 345/60 |
| 2004/0012547 | A1 | 1/2004 | Lee | 345/60 |

OTHER PUBLICATIONS

European Search Report dated Apr. 6, 2006.

* cited by examiner

*Primary Examiner*—Richard Hjerpe
*Assistant Examiner*—Leonid Shapiro
(74) *Attorney, Agent, or Firm*—KED & Associates, LLP

(57) ABSTRACT

The present invention relates to a drive device and method of a plasma display panel in which the manufacturing cost of a PDP can be reduced. The plasma display panel in accordance with the present invention has a drive device comprising: a IC circuit supplying drive voltage to scan electrodes; a energy recovery circuit supplying sustain voltage to the IC circuit; a set up supply part supplying rising ramp wave form to the IC circuit during set up period; and a set down supply part supplying falling ramp wave form to the IC circuit during set down period, wherein said drive device includes a switch which connects the set up supply part to the set down supply part and is turned on or off responding to voltage supplied to the IC drive circuit during the set down period.

14 Claims, 18 Drawing Sheets

PLASMA DISPLAY PANEL AND DRIVE METHOD THEREOF

This Nonprovisional application claims priority under 35 U.S.C. § 119(a) on Patent Application No. 10-2003-0021630 filed in Korea on Apr. 7, 2003, the entire contents of which are hereby incorporated by reference.

BACKGROUND OF THE INVENTION

1. Field of the Invention

The present invention relates to a drive device and method of a plasma display panel (hereinafter, referred to as "PDP"). More particularly, the present invention relates to a drive device and method of PDP in which the manufacturing cost of PDP can be reduced.

Further, the present invention relates to a PDP, and more particularly, to derive method of a PDP, which can decrease the power consumption.

2. Description of the Background Art

A plasma display panel (hereinafter, referred to as "PDP") displays images including characters or graphics since fluorescent material is emitted by ultraviolet rays of 147 nm occurring when inert mixed gases of He+Xe, Ne+Xe, He+Ne+Xe, etc. are discharged. It is easy for this PDP to be made thin and large. The PDP also provides an improved picture quality due to recent advanced technology. In particular, in a 3-electrode AC sheet discharge PDP, wall charges are accumulated on the surface of the PDP upon the discharge of the PDP and electrodes are protected from sputtering occurring due to the discharge. Therefore, the 3-electrode AC sheet discharge PDP advantageously has a low-voltage driving and a long life span.

FIG. 1 shows a perspective view illustrating a discharge cell structure of a 3-electrode ac surface discharge plasma display panel of the background art. As shown in FIG. 1, the discharge cell structure of 3-electrode AC sheet discharge PDP includes a scan electrode 30Y and a sustain electrode 30Z formed on an upper substrate 10, and an address electrode 20X formed on a lower substrate 18.

Each of the scan electrode Y and the sustain electrode Z includes transparent electrodes 12Y and 12Z, and metal bus electrodes 13Y and 13Z having a line width smaller than those of the transparent electrodes 12Y and 12Z and formed in an edge region of one side of the transparent electrodes. The transparent electrodes 12Y and 12Z are usually formed of indium-tin-oxide (hereinafter, referred to as "ITO") on the upper substrate 10.

The metal bus electrodes 13Y and 13Z are formed on the transparent electrodes 12Y and 12Z usually using a metal such as chromium (Cr) and serve to reduce a voltage drop by the transparent electrodes 12Y and 12Z having a high resistance. An upper dielectric layer 14 and a protection film 16 are stacked on the upper substrate 10 in which the scan electrode Y and the sustain electrode Z are formed in parallel. The protection film 16 serves to prevent damage of the upper dielectric layer 14 due to sputtering generated upon the plasma discharge and to increase emission efficiency of secondary electrons. The protection film 16 is usually formed using magnesium oxide (MgO).

The address electrode 20X is formed in the direction intersecting the scan electrode 30Y and the sustain electrode 30Z. A lower dielectric layer 22 and a diaphragm 24 are formed on the lower substrate 18 in which the address electrode 20X is formed. The diaphragm 24 is formed in parallel to the address electrode X and serves to prevent ultraviolet rays and a visible ray generated due to the discharge from leaking toward neighboring discharge cells. The fluorescent material layer 26 is excited by ultraviolet rays generated upon the plasma discharge to generate a visible ray of one of red, green and blue. Inert mixed gases such as He+Xe or Ne+Xe for discharge are inserted into a discharge space of the discharge cell formed between the upper/lower substrates 10, 18 and the diaphragm 24.

In such a 3-electrode AC sheet discharge type PDP, one frame is driven with it divided into several sub-fields having different numbers of emission in order to implement the gray level of a picture. Each sub-field is divided into a reset period for generating discharge uniformly, an address period for selecting a discharge cell and a sustain period for implementing the gray scale depending on the number of discharge.

FIG. 2 shows a frame of a plasma display panel of the background art. As shown in FIG. 2, if it is desired to display a picture using 256 gray scales, the frame period 16.67 ms corresponding to 1/60 second is divided into eight sub-fields SF1 to SF8. Furthermore, each of the eight sub-fields SF1 to SF8 is divided into a reset and address period and a sustain period. The reset and address period of each sub-field are same every sub-field, whereas the sustain period is increased in the ratio of 2n(n=0,1,2,3,4,5,6,7) in each sub-field. As such, since the sustain period varies in each sub-field, it is possible to implement the gray scale of the picture.

The driving method of a PDP is divided into a selective writing mode and a selective erasing mode according to whether the discharge cell selected by addressing discharge is luminous or not.

The selective writing mode turns off all discharge cells during reset period and turns on the discharge cell selected by address discharge during address period. The image is displayed by sustaining discharging of cell selected by address discharge in the sustain period.

In the selective writing mode, wall electrical charge is formed sufficiently in the discharge cell by setting up the width of scan pulse broad relatively (for example 3 μs). However, if the width of the scan pulse is set up broadly, there is problem that the address period is set up broadly and the sustain period is narrowly.

The selective erasing mode turns on all discharge cells during reset period and turns off the discharge cell selected by address discharge during address period. The image is displayed by sustaining discharging of cell which is not selected by address discharge in the sustain period.

In the selective erasing mode, erasing discharge is caused in the discharge cell by setting up the width of scan pulse narrow relatively (for example 1 μs). Therefore, in the selective erasing mode, as the scan pulse of narrow width is used, the address period can be made shorter and the sustain period attributing to brightness can be longer. However, the selective erasing mode has low contrast for the total screen is on during reset period, i.e. non-indication period.

In order to solve such a problem of the selective writing and erasing mode, the mixing method of the selective writing and erasing mode is proposed.

FIG. 3 shows one frame of a PDP of other embodiment of the background art including the subfield of the selective writing and erasing mode as one frame. As shown in FIG. 3, one frame includes selective writing subfield WSF having at least more than one subfield and selective erasing ESF having at least more than one subfield.

The selective writing subfield WSF includes m (m is a positive integer) subfields (SF1, . . . , SFm). The first through the m−1th subfields (SF1,−1) except the mth subfield (SFm) each is divided into reset period forming constant quantity of wall electrical charge uniformly on the cell of the total screen, selective writing address period (hereinafter, referred to as "writing address period",) selecting on-cells by writing discharge, sustain period causing sustain discharge of selected on-cells and erasing period erasing the wall electrical charge after sustain period and sustain discharge.

The mth subfield, which is the last subfield of the selective writing subfield WSF, is divided into reset period, selective writing address period and erasing period. The reset period, writing address period and erasing period of the selective writing subfield WSF are set up equally on the subfields (SF1, . . . , SFm) of the selective erasing subfield (ESF) and the sustain period is set up differently according to relative ratio of brightness.

The selective erasing subfield ESF includes n-m (n is a positive integer and greater than m) subfields (SFm+1, . . . , SFn). The m+1 through n subfields (SFm+1, . . . , SFn) each is divided into selective erasing address period(hereinafter, referred to as "erasing address period ") selecting off-cells by erasing discharge and sustain period causing sustain discharge on on-cells. The erasing address period is set up equally on the subfields (SFm +1, . . . , SFn) of the selective erasing subfield (ESF) and the sustain period is set up differently according to relative ratio of brightness.

In the driving method of FIG. 3, by driving m subfields as selective writing mode and n-m subfields as selective erasing mode, the address period can be made shorter and the contrast can be improved. Stated differently, enough sustain period can be ensured by one frame including selective erasing subfield having short scan pulse. And, the contrast can be improved by one frame's including selective erasing subfield without reset period.

FIG. 4 shows a scan drive device providing driving signal by the drive method of PDP shown in FIG. 3.

As shown in FIG. 4, a scan driving device of a conventional PDP comprises energy recovery circuit 40, drive IC circuit 52, setup supply part 42, set down supply part 47, the first and second non-polar scan voltage supply part 46, 48, scan base voltage supply part 50, the seventh switch Q7 which connected the setup supply part 42 to the drive IC circuit 52, the sixth switch Q6 which connected the energy recovery circuit 40 to the setup supply part 42.

The drive IC circuit 52 is connected to scan base voltage supply part 50 by push-pull mode and comprises the fourteenth and fifteenth switches (Q14, Q15) to which voltage signal is input from energy recovery circuit 40, setup supply part 42, set down supply part 47, the first and second non-polar scan voltage supply part 46, 48 and scan base voltage supply part 50. The output line of the fourteenth and fifteenth switches (Q14, Q15) is connected to one of scan electrode lines.

The energy recovery circuit 40 comprises external capacitor C1 which stores energy recovered from scan electrode line (Y1 through Ym), inductor L1 which connects the external capacitor C1 to the drive IC circuit 52, the first switch Q1 which connects the external capacitor C1 to the inductor L1 by parallel, the first diode D1, the second diode D2 and the second switch Q2.

The working process of the energy recovery circuit 40 is as follows. Firstly, it is assumed that the external capacitor C1 is charged to Vs/2. If the first switch Q1 is turned on, a voltage stored in the external capacitor C1 passes through the first switch Q1, the first diode D1, the inductor L1, internal diode of the sixth switch Q6 and the seventh switch Q7 to be supplied to the drive IC circuit 52. The drive IC circuit 52 supplies the voltage to the scan electrode line (Y1 through Ym). At this time, as the inductor L1 composes a series LC resonance circuit with a capacity of PDP discharge cell, the voltage Vs is supplied to the scan electrode line (Y1 through Ym).

After this, the third switch Q3 is turned on. If the third switch Q3 is turned on, the sustain voltage Vs passes through the internal diode of the sixth switch Q6 and the seventh switch Q7 to be supplied to the drive IC circuit 52. The drive IC circuit 52 supplies the voltage to the scan electrode line (Y1 through Ym). The voltage level of the scan electrode line (Y1 through Ym) keeps sustain voltage Vs by sustain voltage Vs and, according to this, the sustain discharge occurs on the discharge cells.

After the sustain discharge occurs on the discharge cells, the second switch Q2 is turned on. If the second switch Q2 is turned on, the reactive power is recovered to the external capacitor C1 through the scan electrode line (Y1 through Ym), the drive IC circuit 52, the internal diode of the seventh switch Q7, the sixth switch Q6, the inductor L1, the second diode D2 and the second switch Q2. In other words, the energy is recovered to the external capacitor from the PDP. Then, if the fourth switch Q4 is turned on, the voltage of the scan electrode line (Y1 through Ym) keeps ground voltage GND.

The energy recovery circuit 40 recovers the energy from PDP and supplies this energy to the scan electrode line (Y1 through Ym). Therefore the power consumption is reduced while discharging in the setup and sustain period.

The first non-polar scan voltage. supply part 46 includes the eleventh switch Q11 which connected the second node (n2) to writing scan voltage source (−Vw). The eleventh switch Q11 supplies the writing scan voltage −Vw to the drive IC circuit 52 by being turned on or off responding to control signal supplied by timing controller, which is not shown, during the address period of the selective writing subfield WSF.

The second non-polar scan voltage supply part 48 includes the twelfth and thirteenth switch Q12, Q13 which connected the second node n2 to the erasing scan voltage source −Ve. The twelfth and thirteenth switch Q12, Q13 supply the erasing scan voltage −Ve to the drive IC circuit 52 by being turned on or off responding to control signal supplied by timing controller, which is not shown, during the address period of the selective erasing subfield ESF.

The scan base voltage 50 includes the third capacitor C3 which connected the second node n2 to the base voltage source Vsc, the eighth switch Q8 which connected the second node n2 to the base voltage source Vsc and the ninth switch Q9. The eighth switch Q8 and the ninth switch Q9 supply the scan base voltage Vsc to the drive IC circuit 52 by being turned on or off responding to control signal supplied by timing controller, which is not shown, during the address periods of the selective writing and erasing subfields. The third capacitor C3 supplies the voltage which is the value added the voltage of the second node to the voltage of the scan base voltage source Vsc to the eighth switch Q8.

The set down supply part 47 includes the tenth switch Q10 which connects the second node n2 to the writing scan voltage −Vw. The set down supply part 47 decreases the voltage, which is supplied to the drive IC circuit 52, to the writing scan voltage −Vw during the set down period which is included in the reset period of the selective writing subfield WSF(Here, the writing scan voltage −Vw is used as the set down voltage source.).

The set up supply part 42 includes the first diode D1 and the fifth switch Q5 which connect the first node n1 to the set up voltage source Vst, and the second capacitor which connects the energy recovery circuit 40 to the set up voltage source Vst.

The first diode breaks the reverse current which flows from the second capacitor C2 to the set up voltage source Vst. The second capacitor C2 supplies the voltage which is the value added the sustain voltage, which is supplied from the energy recovery circuit 40, to the set up voltage Vst. The fifth switch Q5 supplies the set up voltage to the first node n1 by being turned on or off responding to control signal, which is not shown in FIG. 4, during the reset period of the selective writing subfield WSF.

FIG. 5 shows timing diagrams of switches in the scan drive device for generating rising ramp wave form and falling ramp wave form. The process generating the set up and set down voltage will be described in a more detailed manner with reference to the FIG. 5.

It is assumed that the second capacitor C2 is charged to the set up voltage Vst and the sustain voltage Vs is supplied to the first node from the energy recovery circuit 40 at the time of turning the fifth switch Q5 on.

Referring to FIG. 5, firstly the fifth switch Q5 and the seventh switch Q7 are turned on. At this time, the energy recovery circuit 40 supplies the sustain voltage Vs to the sixth switch Q6. The sustain voltage Vs is supplied to the scan electrode line (Y1, . . . , Ym) through an internal diode of the sixth switch Q6, the seventh switch Q7 and the drive IC circuit 52. Therefore, The voltage of the scan electrode line (Y1, . . . , Ym) rises suddenly to Vs.

And, for the sustain voltage Vs is supplied to the negative polar terminal of the second capacitor C2, the second capacitor C2 supplies the voltage Vs+Vst to the fifth switch Q5. The fifth switch Q5 supplies the voltage, which is supplied by the second capacitor C2, to the first node n1 with a slope by a variable resistor which is installed at the front side of the fifth switch Q5. The voltage, which is supplied to the first node n1, is supplied to the scan electrode line (Y1, . . . ,Ym) through the seventh switch Q7 and the drive IC circuit 52. Therefore, the voltage of rising ramp wave form(Ramp-up) is supplied to the scan electrode line (Y1, . . . , Ym).

The fifth switch Q5 is turned off after supplying the voltage of rising ramp wave form (Ramp-up) to the scan electrode line (Y1, . . . , Ym). If the fifth switch Q5 is turned off, the voltage Vs, which is supplied by the energy recovery circuit 40, is only supplied to the first node n1. Therefore, the voltage of the scan electrode line (Y1, . . . , Ym) falls to the sustain voltage Vs.

Then, during the set down period, the seventh switch Q7 is turned off and the tenth switch Q10 is turned on. The tenth switch Q10 decreases the voltage of the second node n2 to the writing scan voltage Vw (or the set down voltage) with a slope by a variable resistor which is installed at the front side of the tenth switch Q10. Therefore, the voltage of falling ramp wave form (Ramp-down) is supplied to the scan electrode line (Y1, . . . , Ym).

The set up supply part 42 and the set down supply part 47 supply the voltage of rising ramp wave form (Ramp-up) and the voltage of falling ramp wave form (Ramp-down) to the scan electrode line (Y1, . . . , Ym) during the reset period by repeating this process. However, in the like this conventional drive device, as the difference between the voltage of the first node n1 and the voltage of the second node n2 is big, the seventh switch Q7 must have big endurance voltage. Therefore, it suffers high manufacturing cost.

Here, as the directions of the internal diodes of the seventh switch Q7 and the sixth switch Q6 are different with each other, it is prevented that the voltage of the second node n2 is supplied to the ground voltage GND through the internal diode of the sixth diode Q6 and. the internal diode of the fourth diode Q4. During the set down period, the voltage of the first node n1 is Vs and the voltage of the second node n2 is −Vw. If Vs is 180V and −Vw is −70V, the endurance voltage of the seventh switch Q7 must be about 250V (actually, according to the margin of the drive voltage, 300V). Therefore, as the switching device of big endurance voltage must be used as the seventh switch Q7, the manufacturing cost increases.

As the reset voltage and the sustain voltage pass on the sixth switch Q6 and the seventh switch Q7, the sixth switch Q6 and the seventh switch Q7 must be endure high voltage over than the reset voltage which supply the set up wave form and, accordingly, the switch Q6 and Q7 each uses five Field Effect Transistors (hereinafter, referred to as "FET"). Therefore, as totally ten FETs are used for protecting the circuit, the manufacturing cost and the energy loss increases.

SUMMARY OF THE INVENTION

Accordingly, an object of the present invention is to solve at least the problems and disadvantages of the background art.

An object of the present invention is to provide a plasma display panel and a drive method thereof in which the manufacturing cost is reduced.

Another object of the present invention is to provide a plasma display panel in which the number of switch device and the loss of energy are reduced.

According to an aspect of the present invention, a plasma display panel has a drive device comprising: a IC circuit supplying drive voltage to scan electrodes; a energy recovery circuit supplying sustain voltage to the IC circuit; a set up supply part supplying rising ramp wave form to the IC circuit during set up period; and a set down supply part supplying falling ramp wave form to the IC circuit during set down period, wherein said drive device includes a switch which connects the set up supply part to the set down supply part and is turned on or off responding to voltage supplied to the IC drive circuit during the set down period.

According to another aspect of the present invention, a plasma display panel has a drive device comprising: a IC circuit supplying drive voltage to scan electrodes; a energy recovery circuit supplying sustain voltage to the IC circuit; a set up supply part supplying rising ramp wave form to the IC circuit during set up period; and a set down supply part supplying falling ramp wave form to the IC circuit during set down period, wherein said drive device includes a switch which is connected by parallel to the IC circuit and is turned on or off responding to voltage supplied to the IC drive circuit during the set down period.

According to another aspect of the present invention, a drive method of plasma display panel uses a drive device comprising: a IC circuit supplying drive voltage to scan electrodes; a energy recovery circuit supplying sustain voltage to the IC circuit; a set up supply part supplying rising ramp wave form to the IC circuit during set up period; and a set down supply part supplying falling ramp wave form to the IC circuit during set down period, wherein the drive method includes a step at which the set up supply part supplies rising ramp wave form to the scan electrodes during the set up period, a step at which the set down supply part supplies falling ramp wave form to the scan electrodes during the set down period, and a step turning the switch, which connects the set up supply part to the set down supply part, on or off responding to the voltage supplied to the scan electrodes during the set up period and set down period.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

First Embodiment

According to an aspect of the present invention, a plasma display panel has a drive device comprising: a IC circuit supplying drive voltage to scan electrodes; a energy recovery circuit supplying sustain voltage to the IC circuit; a set up supply part supplying rising ramp wave form to the IC circuit during set up period; and a set down supply part supplying falling ramp wave form to the IC circuit during set down period, wherein said drive device includes a switch which connects the set up supply part to the set down supply part and is turned on or off responding to voltage supplied to the IC drive circuit during the set down period.

Figure 1:
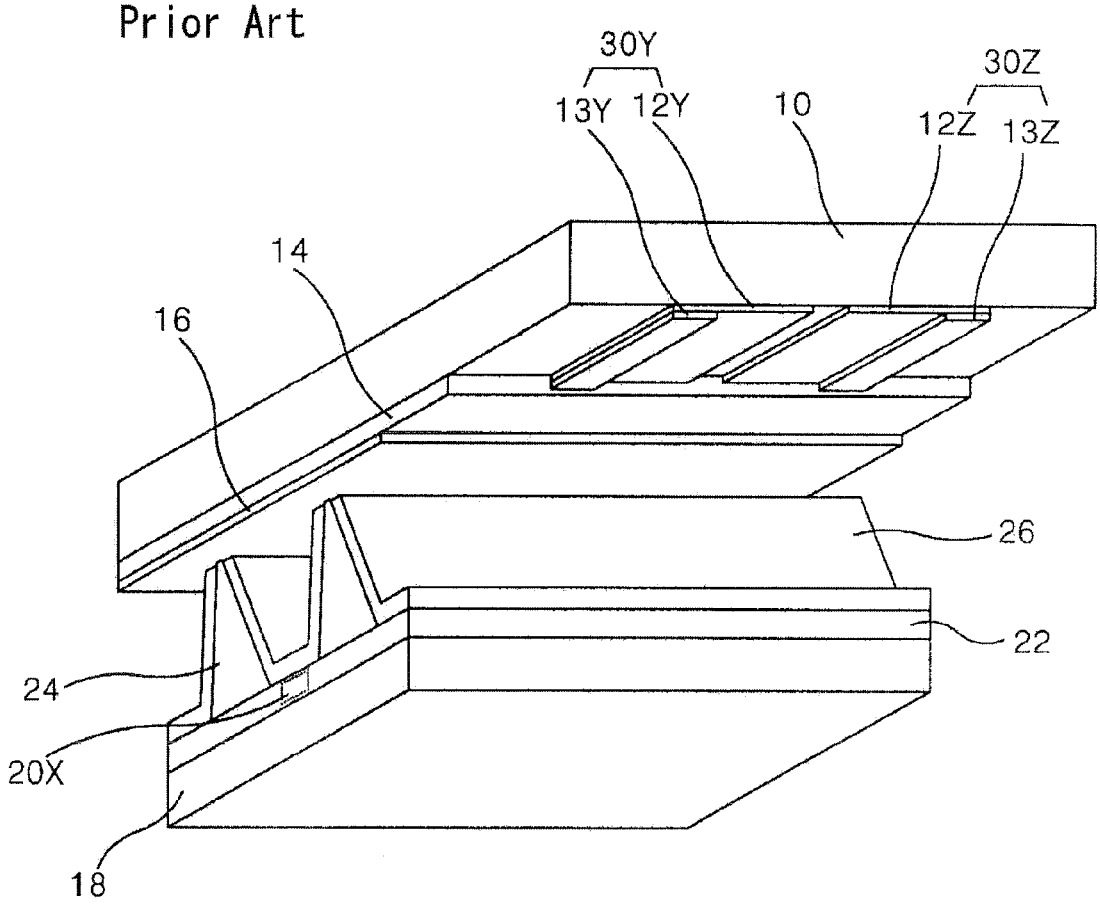
Fig. 1 Prior Art
FIG. 1 shows a perspective view illustrating a discharge cell structure of a 3-electrode ac surface discharge plasma display panel of the background art.
Figure 2:
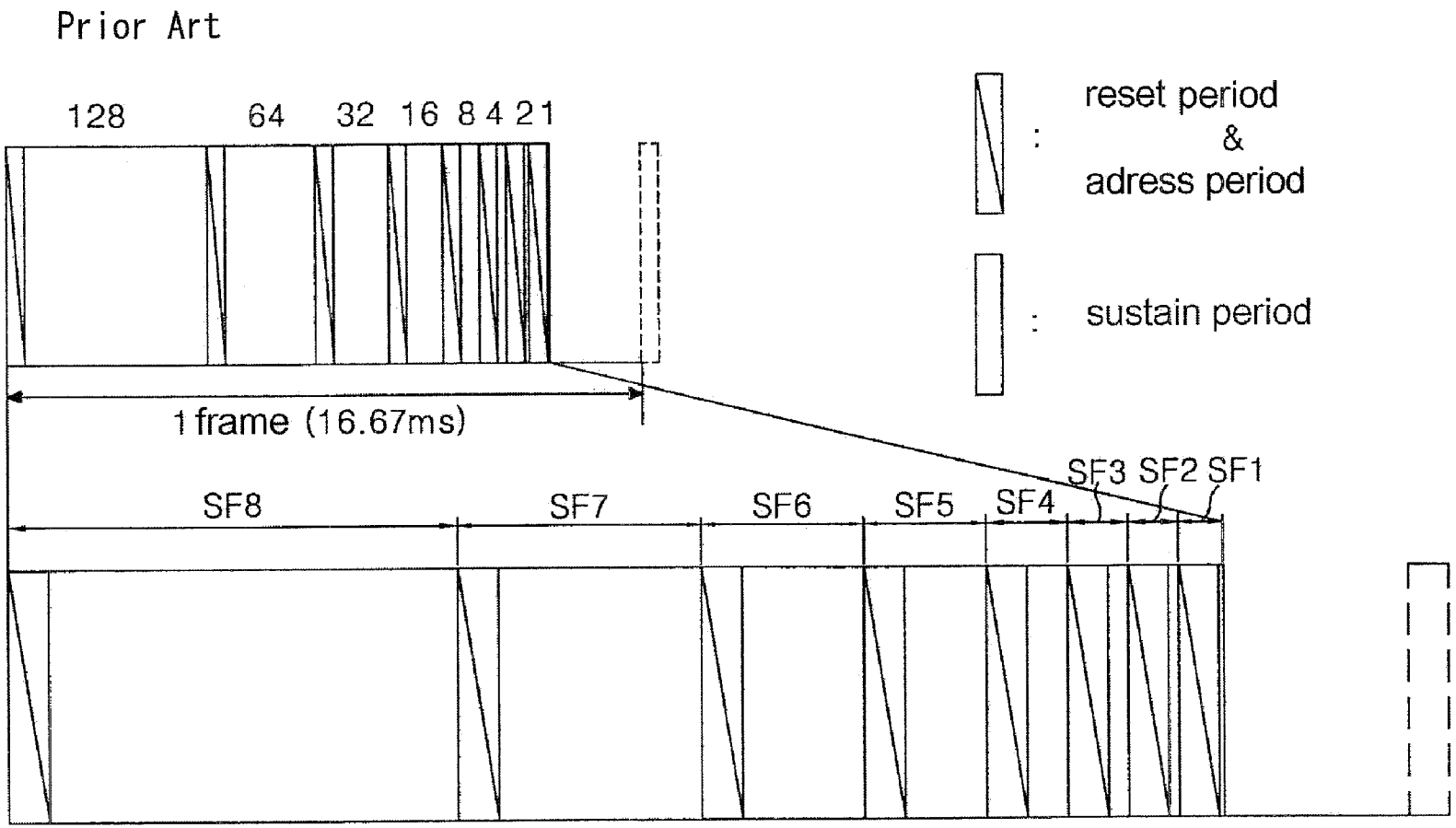
FIG. 2 shows one frame of a plasma display panel of the background art.
Figure 3:
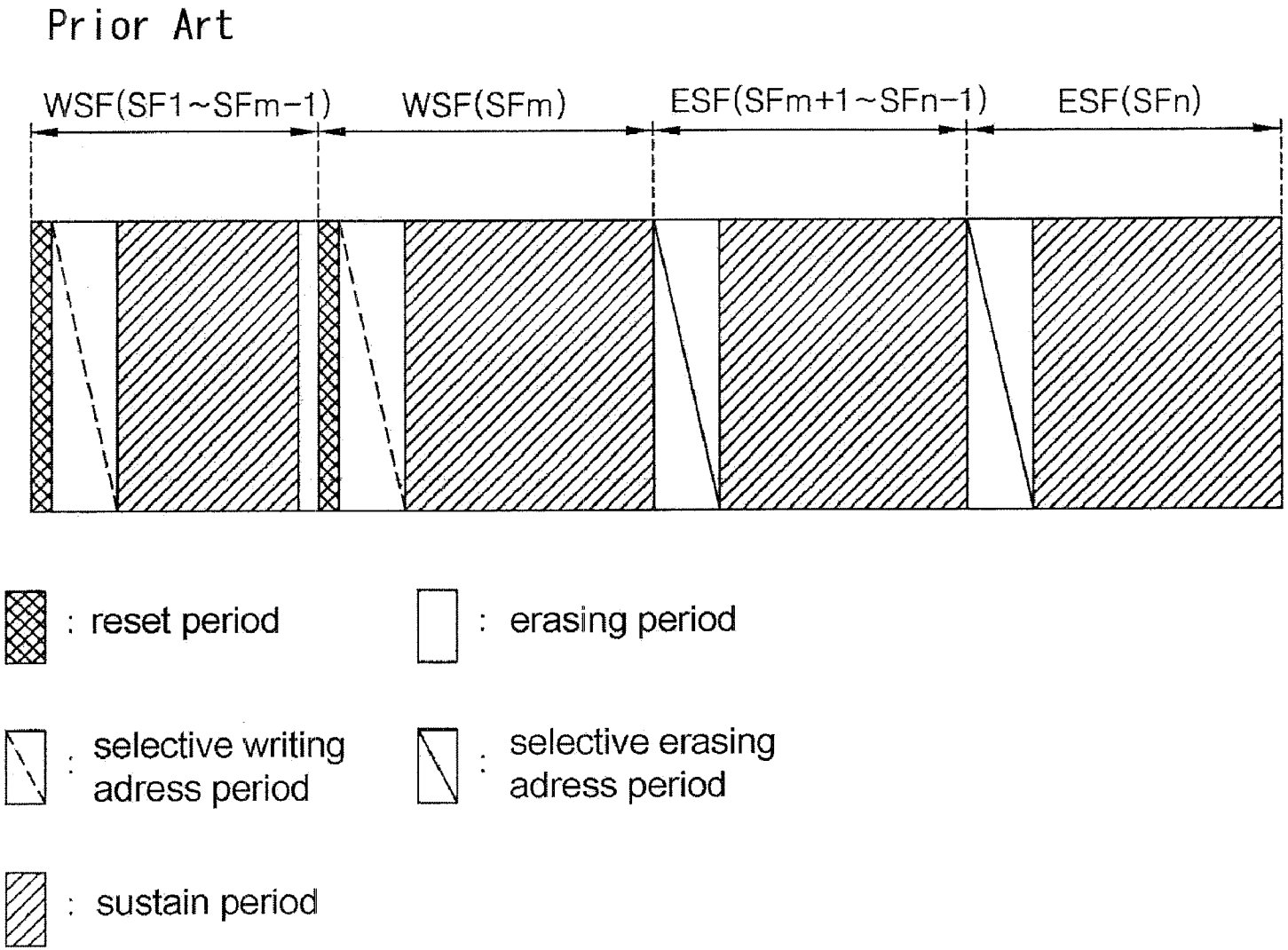
FIG. 3 shows one frame of a PDP of other embodiment of the background art including the subfield of the selective writing and erasing mode as one frame.
Figure 4:
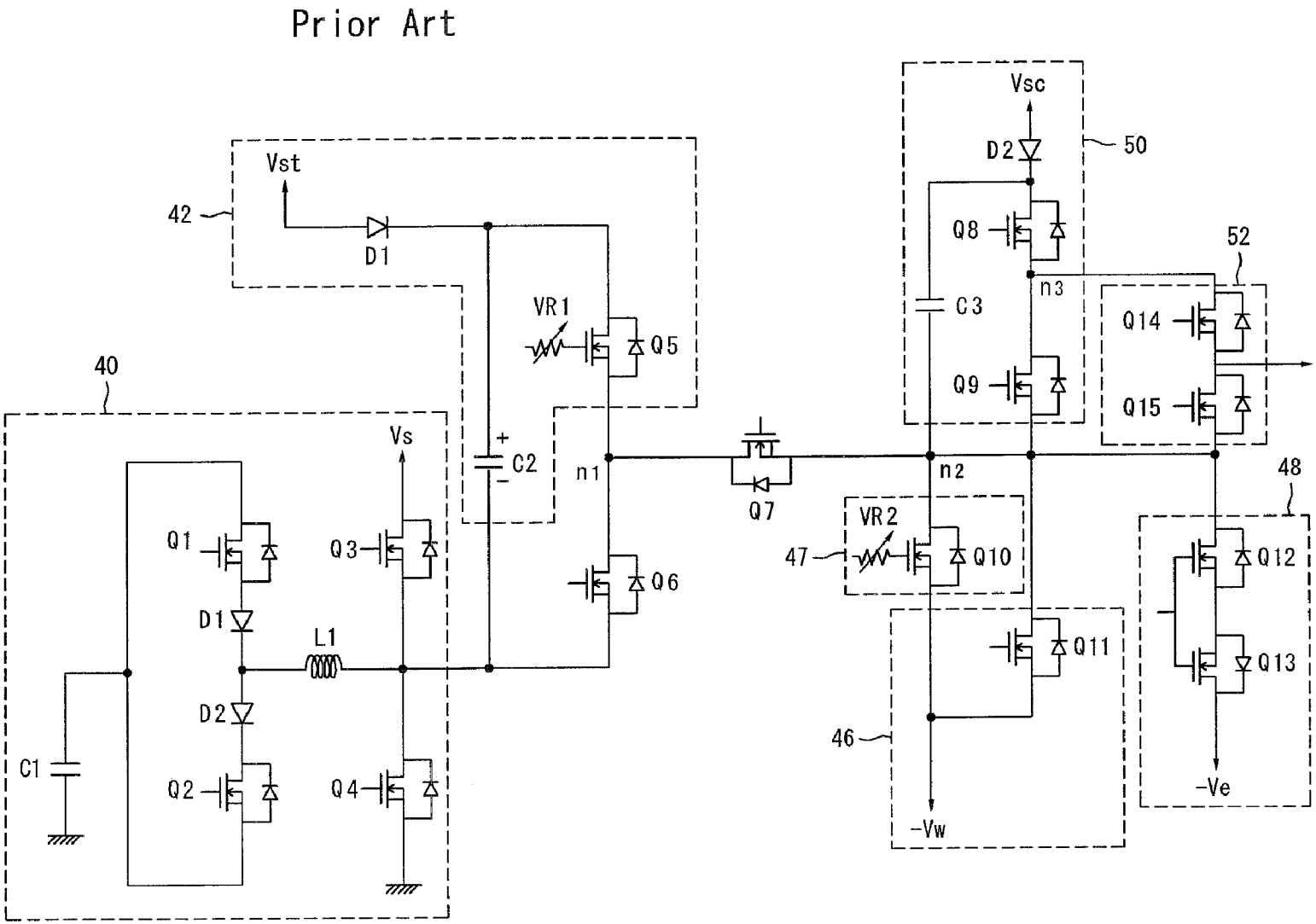
FIG. 4 shows a scan drive device providing driving signal by the drive method of PDP shown in FIG. 3.
Figure 5:
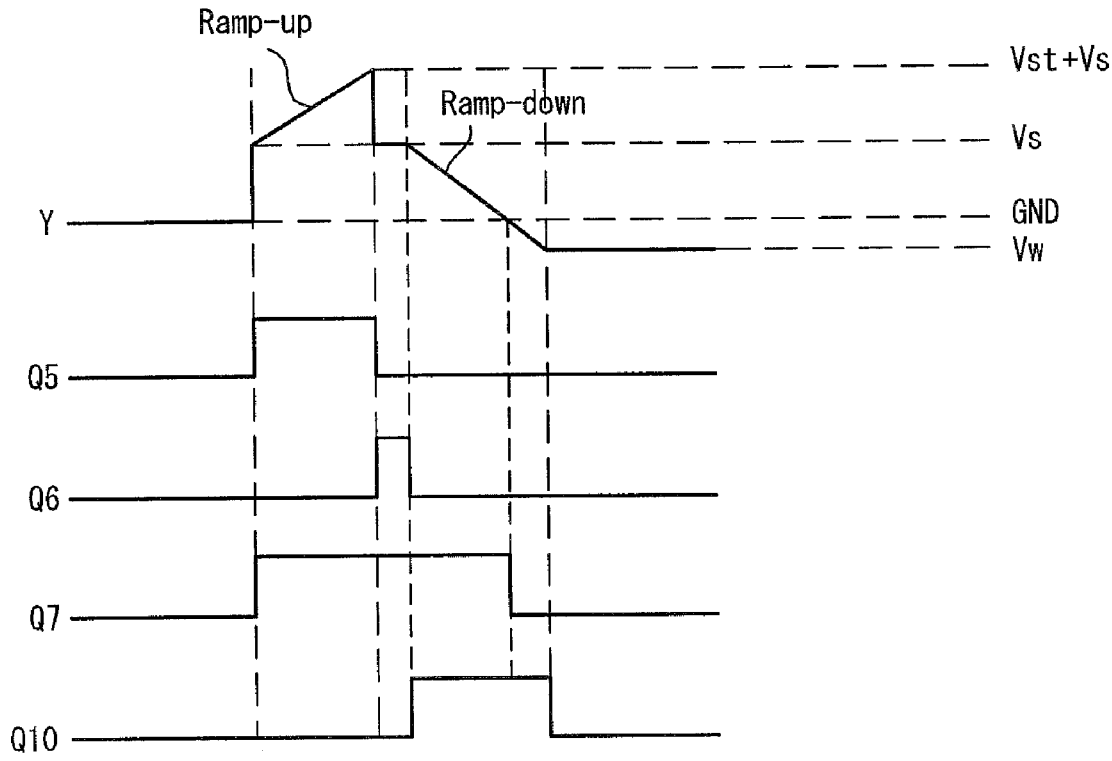
Fig. 5 Prior Art
FIG. 5 shows timing diagrams of switches in the scan drive device of FIG. 4 for generating rising ramp wave form and falling ramp wave form during the reset period.
Figure 6:
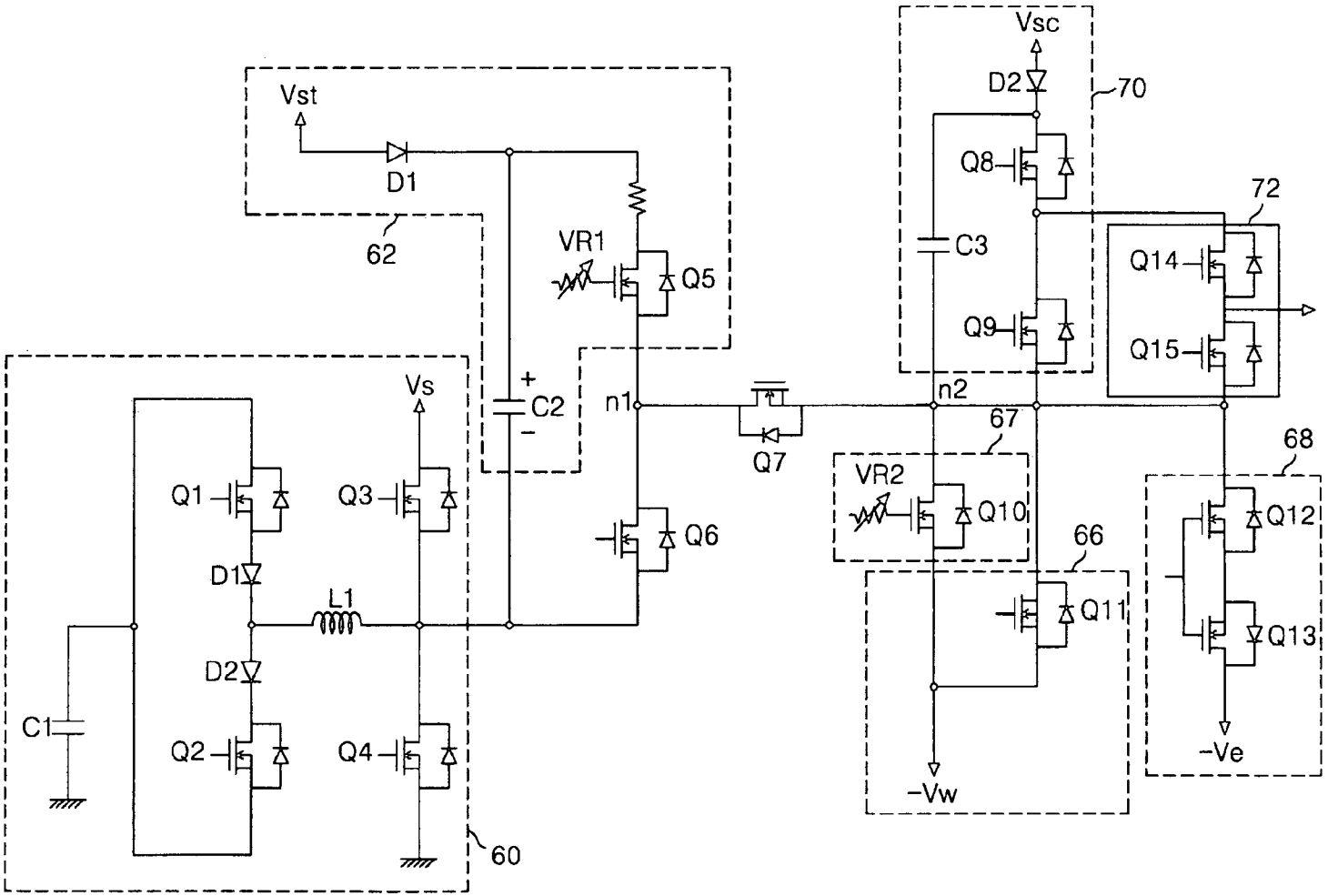
FIG. 6 shows a scan drive device of a plasma display panel in accordance with the first embodiment of the present invention.

FIG. 6 shows a scan drive device of a plasma display panel in accordance with the first embodiment of the present invention.

As shown in FIG. 6, a scan drive device of a plasma display panel in accordance with the first embodiment of the present invention comprises an energy recovery circuit 60, a drive IC circuit 72, a set up supply part 62, a set down supply part 67, the first and second negative polar scan voltage supply part 66, 68, a scan base voltage supply part 70, the seventh switch Q7 which connects the set up supply part 62 to the drive IC circuit 72, the sixth switch Q6 which connects the energy recovery circuit 60 to the set up supply part 62, and a timing controller which is not shown.

The drive IC circuit 72 is connected to scan base voltage supply part 70 by push-pull mode and comprises the fourteenth and fifteenth switches Q14, Q15 to which voltage signal is input from the energy recovery circuit 60, the setup supply part 62, the set down supply part 67, the first and second non-polar scan voltage supply part 66, 68 and the scan base voltage supply part 70. The output line of the fourteenth and fifteenth switches Q14, Q15 is connected to one of scan electrode lines.

The energy recovery circuit 60 comprises external capacitor C1 which stores energy recovered from scan electrode line (Y1 through Ym), inductor L1 which connects the external capacitor C1 to the drive IC circuit 72, the first switch Q1 which connects the external capacitor C1 to the inductor L1 by parallel, the first diode D1, the second diode D2 and the second switch Q2.

The working process of the energy recovery circuit 60 is as follows. Firstly, it is assumed that the external capacitor C1 is charged to Vs/2. If the first switch Q1 is turned on, a voltage stored in the external capacitor C1 passes through the first switch Q1, the first diode D1, the inductor L1, internal diode of the sixth switch Q6 and the seventh switch Q7 to be supplied to the drive IC circuit 72. The drive IC circuit 52 supplies the voltage to the scan electrode line (Y1 through Ym). At this time, as the inductor L1 composes a series LC resonance circuit with a capacity of PDP discharge cell, the voltage Vs is supplied to the scan electrode line (Y1 through Ym).

After this, the third switch Q3 is turned on. If the third switch Q3 is turned on, the sustain voltage Vs passes through the internal diode of the sixth switch Q6 and the seventh switch Q7 to be supplied to the drive IC circuit 72. The drive IC circuit 72 supplies the voltage to the scan electrode line (Y1 through Ym). The voltage level of the scan electrode line (Y1 through Ym) keeps sustain voltage Vs by sustain voltage Vs and, according to this, the sustain discharge occurs on the discharge cells.

After the sustain discharge occurs on the discharge cells, the second switch Q2 is turned on. If the second switch Q2 is turned on, the reactive power is recovered to the external capacitor C1 through the scan electrode line (Y1 through Ym), the drive IC circuit 72, the internal diode of the seventh switch Q7, the sixth switch Q6, the inductor L1, the second diode D2 and the second switch Q2. In other words, the energy is recovered to the external capacitor from the PDP. Then, if the fourth switch Q4 is turned on, the voltage of the scan electrode line (Y1 through Ym) keeps ground voltage GND.

The energy recovery circuit 60 recovers the energy from PDP and supplies this energy to the scan electrode line (Y1 through Ym). Therefore the power consumption is reduced while discharging in the setup and sustain period.

The first non-polar scan voltage supply part 66 includes the eleventh switch Q11 which connected the second node (n2) to writing scan voltage source (−Vw). The eleventh switch Q11 supplies the writing scan voltage −Vw to the drive IC circuit 72 by being turned on or off responding to control signal supplied by timing controller, which is not shown, during the address period of the selective writing subfield WSF.

The second non-polar scan voltage supply part 68 includes the twelfth and thirteenth switch Q12, Q13 which connected the second node n2 to the erasing scan voltage source −Ve. The twelfth and thirteenth switch Q12, Q13 supply the erasing scan voltage −Ve to the drive IC circuit 52 by being turned on or off responding to control signal supplied by timing controller, which is not shown, during the address period of the selective erasing subfield ESF.

The scan base voltage 70 includes the third capacitor C3 which connected the second node n2 to the base voltage source Vsc, the eighth switch Q8 which connected the second node n2 to the base voltage source Vsc and the ninth switch Q9. The eighth switch Q8 and the ninth switch Q9 supply the scan base voltage Vsc to the drive IC circuit 72 by being turned on or off responding to control signal supplied by timing controller, which is not shown, during the address periods of the selective writing and erasing subfields. The third capacitor C3 supplies the voltage which is the value added the voltage of the second node to the voltage of the scan base voltage source Vsc to the eighth switch Q8.

The set down supply part 67 includes the tenth switch Q10 which connects the second node n2 to the writing scan voltage −Vw. The set down supply part 67 decreases the voltage which is supplied to the drive IC circuit 72, to the writing scan voltage −Vw during the set down period which is included in the reset period of the selective writing subfield WSF (Here, the writing scan voltage −Vw is used as the set down voltage source.).

The set up supply part 62 includes the first diode D1 and the fifth switch Q5 which connect the first node n1 to the set up voltage source Vst, and the second capacitor which connects the energy recovery circuit 60 to the set up voltage source Vst. The first diode breaks the reverse current which flows from the second capacitor C2 to the set up voltage source Vst. The second capacitor C2 supplies the voltage which is the value added the sustain voltage, which is supplied from the energy recovery circuit 60, to the set up voltage Vst. The fifth switch Q5 supplies the set up voltage to the first node n1 by being turned on or off responding to control signal, which is not shown, during the reset period of the selective writing subfield WSF.

Figure 7:
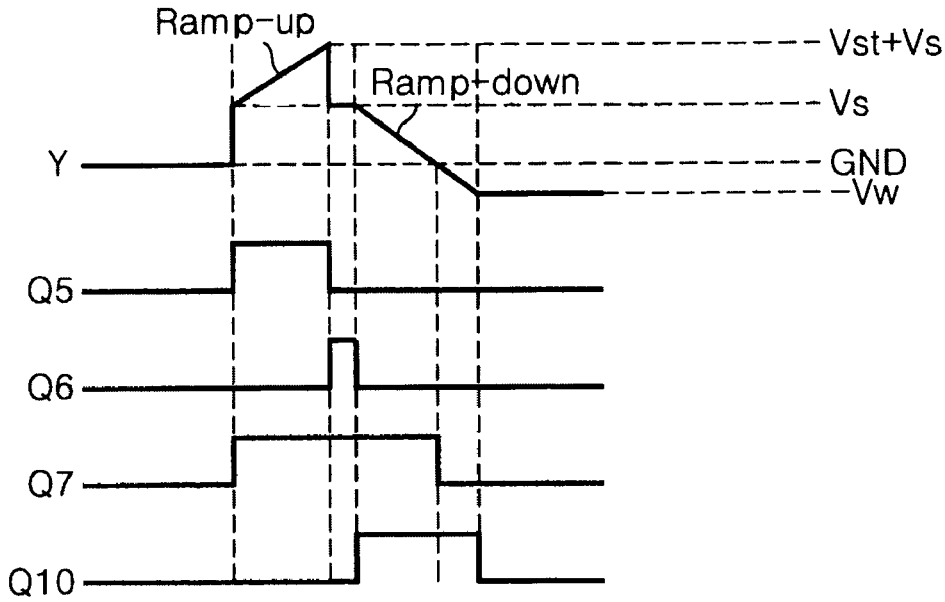
FIG. 7 shows timing diagrams of switches in a scan drive device of FIG. 6 for generating rising ramp wave form and falling ramp wave form during the reset period.

FIG. 7 shows timing diagrams of switches in a scan drive device of FIG. 6 for generating rising ramp wave form and falling ramp wave form during the reset period.

It is assumed that the second capacitor C2 is charged to the set up voltage Vst and the sustain voltage Vs is supplied to the first node from the energy recovery circuit 60 at the time of turning the fifth switch Q5 on.

Referring to FIG. 7, firstly the fifth switch Q5 and the seventh switch Q7 are turned on. At this time, the energy recovery circuit 60 supplies the sustain voltage Vs to the sixth switch Q6. The sustain voltage Vs is supplied to the scan electrode line (Y1, . . . , Ym) through an internal diode of the sixth switch Q6, the seventh switch Q7 and the drive IC circuit 72. Therefore, The voltage of the scan electrode line (Y1, . . . , Ym) rises suddenly to Vs.

And, for the sustain voltage Vs is supplied to the negative polar terminal of the second capacitor C2, the second capacitor C2 supplies the voltage Vs+Vst to the fifth switch Q5. The fifth switch Q5 supplies the voltage, which is supplied by the second capacitor C2, to the first node n1 with a slope by a variable resistor which is installed at the front side of the fifth switch Q5. The voltage, which is supplied to the first node n1, is supplied to the scan electrode line (Y1, . . . , Ym) through the seventh switch Q7 and the drive IC circuit 72. Therefore, the voltage of rising ramp wave form(Ramp-up) is supplied to the scan electrode line (Y1, . . . , Ym).

After supplying the voltage of rising ramp wave form (Ramp-up) to the scan electrode line (Y1, . . . , Ym), the fifth switch Q5 is turned off and the sixth switch Q6 is turned on. If the sixth switch Q6 is turned on, the voltage Vs, which is supplied by the energy recovery circuit 60, is supplied to the first node n1. Therefore, the voltage of the scan electrode line (Y1, Ym) falls suddenly to the sustain voltage Vs.

Then, during the set down period, the sixth switch Q6 is turned off and the tenth switch Q10 is turned on. And, during a part of the set down period, that is, until the voltage of the second node n2 is greater than or equal to about ground voltage, the seventh switch Q7 remains turned on. This is controlled by the timing controller which is not shown in FIG. 6. And, during the set down period, the energy recovery circuit 60 does not supply the voltage Vs.

The tenth switch Q10 decreases the voltage of the second node n2 to the writing scan voltage −Vw (or the set down voltage) with a slope by a variable resistor which is installed at the front side of the tenth switch Q10. Therefore, the voltage of falling ramp wave form (Ramp-down) is supplied to the scan electrode line (Y1, . . . , Ym). Here, because the seventh switch Q7 remains turned on, the voltage of the first node n1 is equal to the voltage of the second node n2.

Then, when the voltage of the second node n2 becomes about ground voltage, the timing controller turns the seventh switch Q7 off. Therefore, the voltage of the first node n1 remains ground voltage and the voltage of the second node n2 falls to the writing scan voltage Vw (or the set down voltage).

Actually, the set up supply part 62 and the set down supply part 67 supply the voltage of rising ramp wave form (Ramp-up) and the voltage of falling ramp wave form (Ramp-down) to the scan electrode line (Y1, . . . , Ym) during the reset period by repeating this process. On the other hand, the seventh switch Q7 can have small endurance voltage in the present invention. That is, as the maximum voltage difference between the voltage of the first node n1 and the voltage of the second node n2 during the reset period, the switch of small endurance voltage can be used for the seventh switch Q7 and, accordingly, the manufacturing cost can be reduced.

Figure 8:
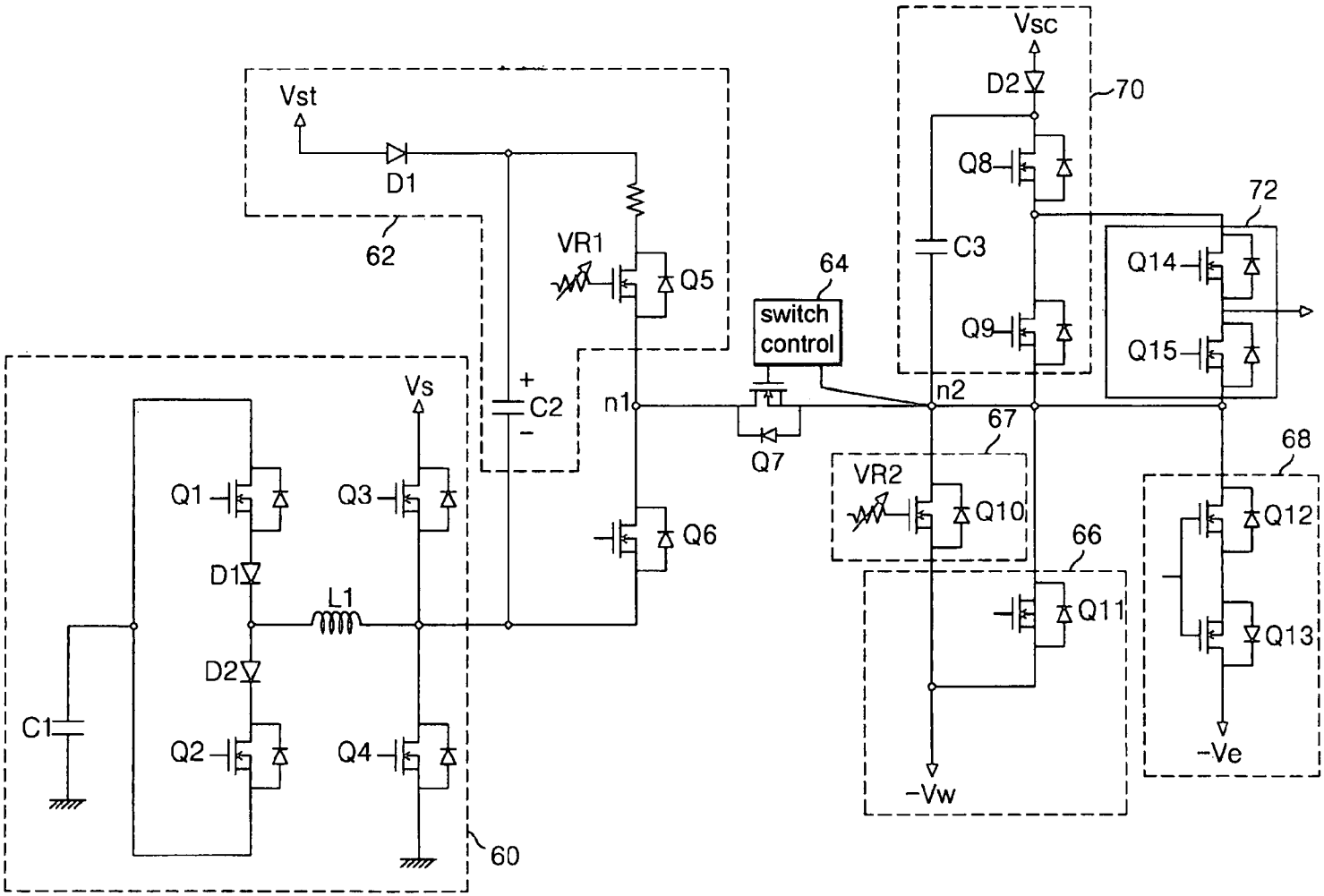
FIG. 8 shows a scan drive device of a plasma display panel in accordance with the modified first embodiment of the present invention.

FIG. 8 shows a scan drive device of a plasma display panel in accordance with the modified first embodiment of the present invention.

As shown in FIG. 8, a scan drive device of a plasma display panel in accordance with the modified first embodiment of the present invention includes further a switch control part 64 for controlling the seventh switch Q7 than the scan drive device which is shown in FIG. 6.

The switch control part 64 controls the seventh switch Q7 responding to the voltage of the second node n2 during the reset period. That is, the switch control part 64 remains the seventh switch Q7 to be turned on until the voltage of the second node n2 becomes about ground voltage. The timing diagrams of the switches are same as FIG. 7.

That is, during a part of the set down period, the switch control part 64 remains the seventh switch Q7 to be turned on when the voltage of the second node n2 is greater than or equal to ground voltage and remains the seventh switch Q7 to be turned off when the voltage of the second node n2 is less than ground voltage by checking the voltage of the second node n2.

Therefore, the switch of small endurance voltage can be used for the seventh switch Q7. That is, as the maximum voltage difference between the voltage of the first node n1 and the voltage of the second node n2 during the reset period, the switch of small endurance voltage can be used for the seventh switch Q7 and, accordingly, the manufacturing cost can be reduced.

Figure 9:
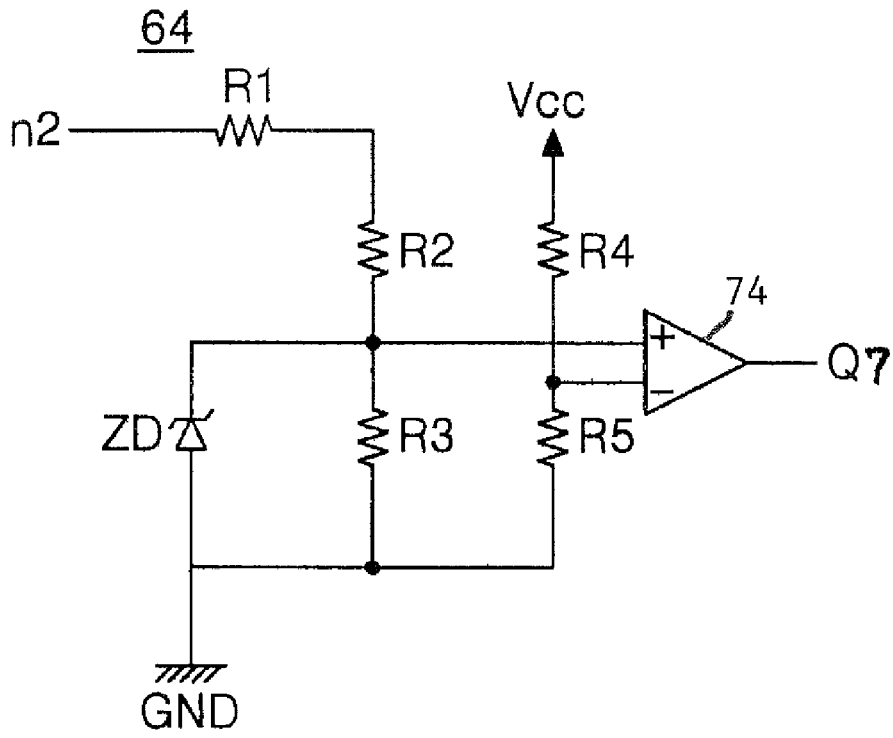
FIG. 9 shows a detailed constitution of the switch control part.

FIG. 9 shows a detailed constitution of the switch control part.

As shown in FIG. 9, the switch control part 64 comprises a first through third resistors R1, R2, R3 for distributing voltage which connect the second node n2 to the ground voltage source in series, a zener diode ZD which connects the third resistor R3 to the ground voltage source in parallel, a fourth and a fifth resistor R4, R5 for distributing voltage which connect a base voltage source to the ground voltage source in series, and a comparative device 74 which generates a control signal by comparing the voltages of the third resistor R3 and the fifth resistor R5.

The first through third resistors R1, R2, R3 distribute the voltage of the second node n2. The zener diode supplies a rating voltage to the comparative device 74 when the voltage of the third resistor R3 becomes negative polar voltage. The fourth and fifth resistors R4, R5 distribute the voltage of the base voltage source Vcc. Here, the resistances of the fourth and fifth resistors R4, R5 are fixed in order that the voltage of the fifth resistor R5 becomes about ground voltage.

The comparative device 74 controls the seventh switch Q7 by checking the voltages of the third resistor R3 and the fifth resistor R5. Here, the comparative device 74 turns the seventh switch Q7 on when the voltage of the third resistor R3 is greater than that of the fifth resistor R5 and turns the seventh switch Q7 off when the voltage of the third resistor R3 is less than that of the fifth resistor R5.

Describing operating process, firstly, if the voltage of the second node n2 becomes positive polar voltage, positive polar voltage is inducted to the third resistor R3. At this time, for the voltage of the third resistor R3 is greater than the voltage of the fifth resistor R5, the comparative device 74 remains the seventh switch Q7 to be turned on. After this, if the voltage of the second node n2 becomes negative polar voltage, negative polar voltage is inducted to the third resistor R3. At this time, for the voltage of the third resistor R3 is less than the voltage of the fifth resistor R5, the comparative device 74 remains the seventh switch Q7 to be turned off.

Figure 10:
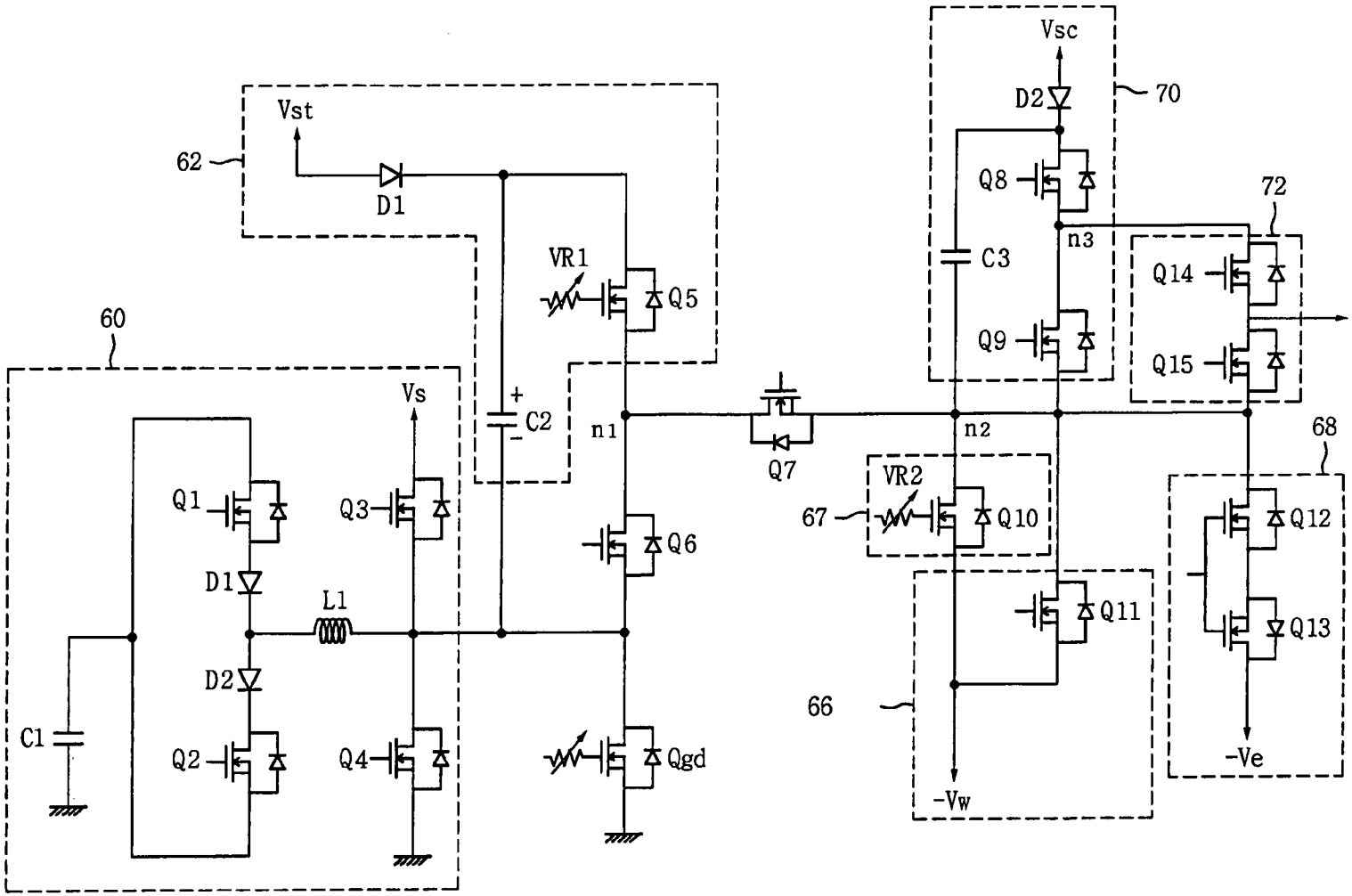
FIG. 10 shows a scan drive device of a plasma display panel in accordance with another modified first embodiment of the present invention.

FIG. 10 shows a scan drive device of a plasma display panel in accordance with another modified first embodiment of the present invention.

As shown in FIG. 10, a scan drive device of a plasma display panel in accordance with another modified first embodiment of the present invention includes further a ground switch Qgd which connects one terminal of the sixth switch Q6, which connects the energy recovery circuit 60 to the set up supply part 62, to ground voltage.

Figure 11:
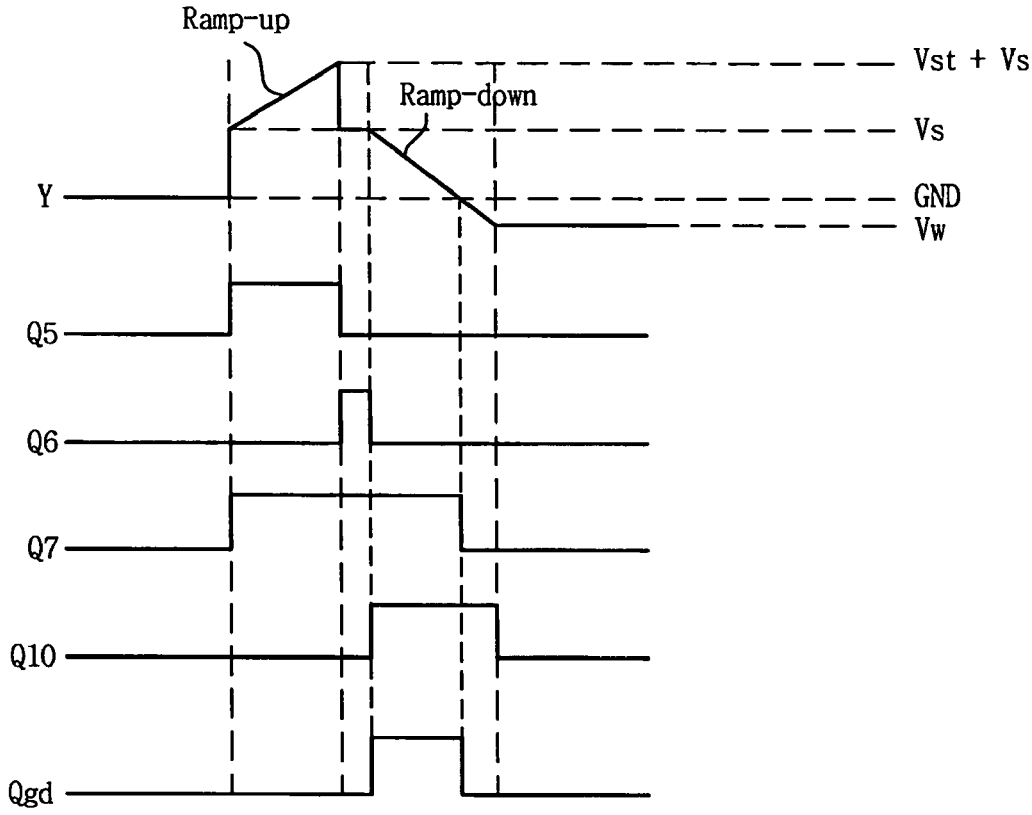
FIG. 11 shows timing diagrams of switches in a scan drive device of FIG. 10 for generating rising ramp wave form and falling ramp wave form during the reset period.

FIG. 11 shows timing diagrams of switches in a scan drive device of FIG. 10 for generating rising ramp wave form and falling ramp wave form during the reset period.

As shown in FIG. 11, the ground switch Qgd is turned on while remaining the seventh switch Q7 to be turned on in the period of the falling ramp wave form. If the ground switch Qgd is turned on, the voltage of the first node n1, that is one terminal of the seventh switch Q7, becomes ground voltage. Therefore, the endurance voltage of the seventh switch can be reduced strictly.

Figure 12:
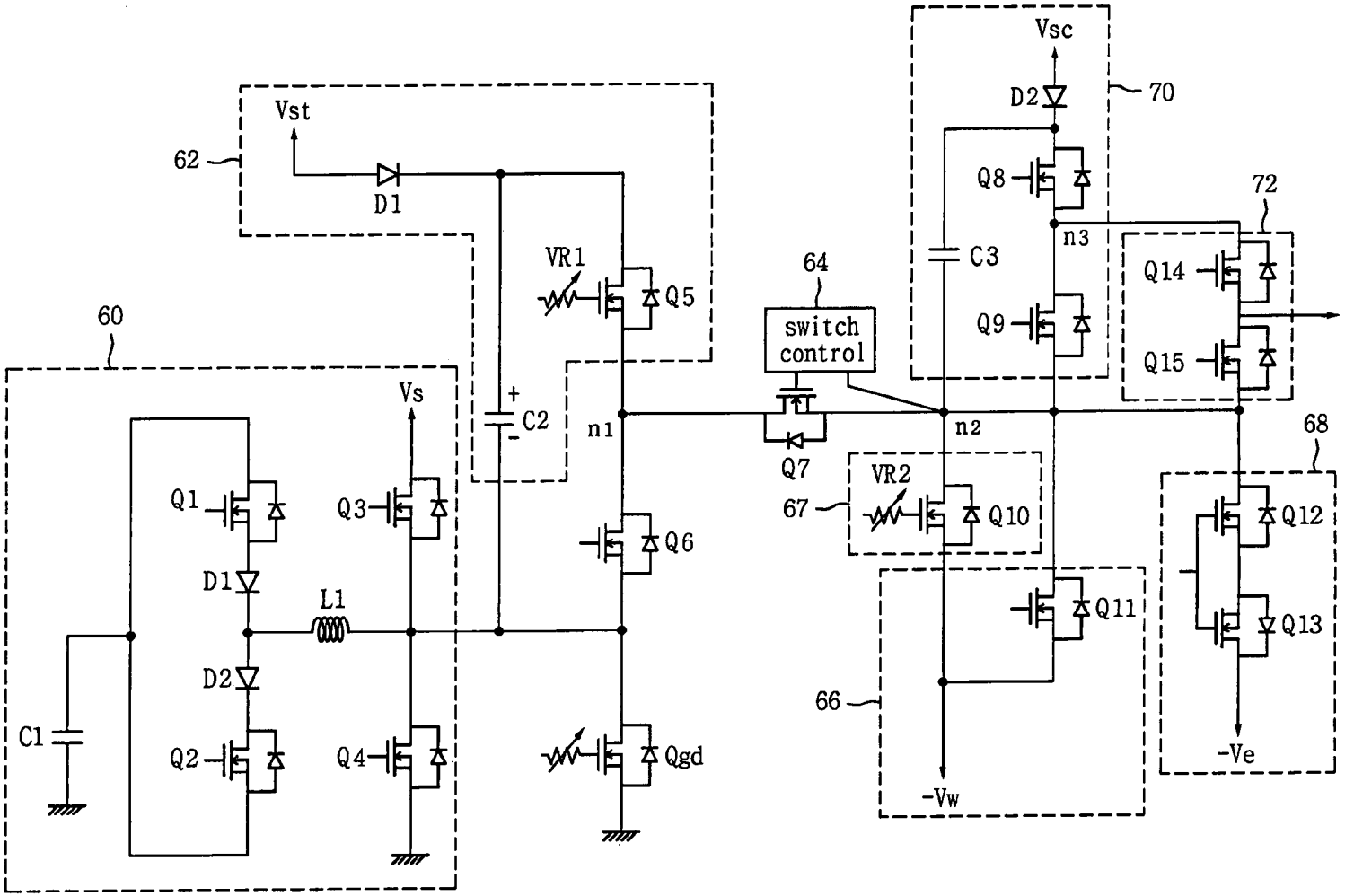
FIG. 12 shows a scan drive device of a plasma display panel in accordance with another modified first embodiment of the present invention.

FIG. 12 shows a scan drive device of a plasma display panel in accordance with another modified first embodiment of the present invention.

As shown in FIG. 12, the addition of the ground switch Qgd can be applied to the scan drive device of FIG. 8. The operating process of this case is same to that of FIG. 11.

Second Embodiment

According to another aspect of the present invention, a plasma display panel has a drive device comprising: a IC circuit supplying drive voltage to scan electrodes; a energy recovery circuit supplying sustain voltage to the IC circuit; a set up supply part supplying rising ramp wave form to the IC circuit during set up period; and a set down supply part supplying falling ramp wave form to the IC circuit during set down period, wherein said drive device includes a switch which is connected by parallel to the IC circuit and is turned on or off responding to voltage supplied to the IC drive circuit during the set down period.

Figure 13:
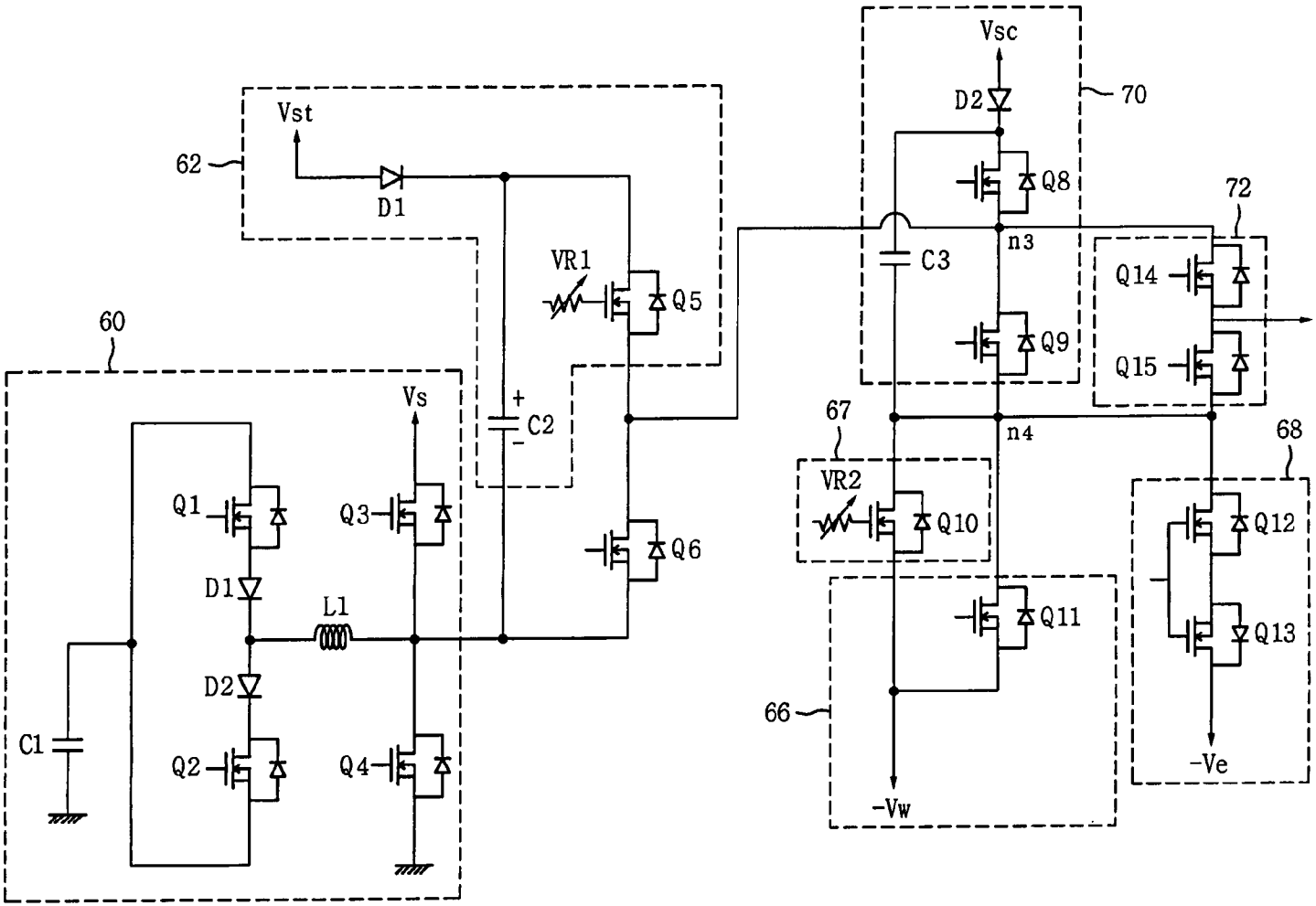
FIG. 13 shows a scan drive device of a plasma display panel in accordance with the second embodiment of the present invention.

FIG. 13 shows a scan drive device of a plasma display panel in accordance with the second embodiment of the present invention.

As shown in FIG. 13, a scan drive device of a plasma display panel in accordance with the second embodiment of the present invention comprises an energy recovery circuit 60, a drive IC circuit 72, a set up supply part 62, a set down supply part 67, the first and second negative polar scan voltage supply part 66, 68, a scan base voltage supply part 70, the sixth switch Q6 which connects the energy recovery circuit 60 to the set up supply part 62, and a timing controller which is not shown.

In the second embodiment of the present invention, the timing controller controls the ninth switch Q9 which is connected to the drive IC circuit 72 by parallel like the seventh switch Q7 of the first embodiment which is shown in FIG. 6.

Figure 14:
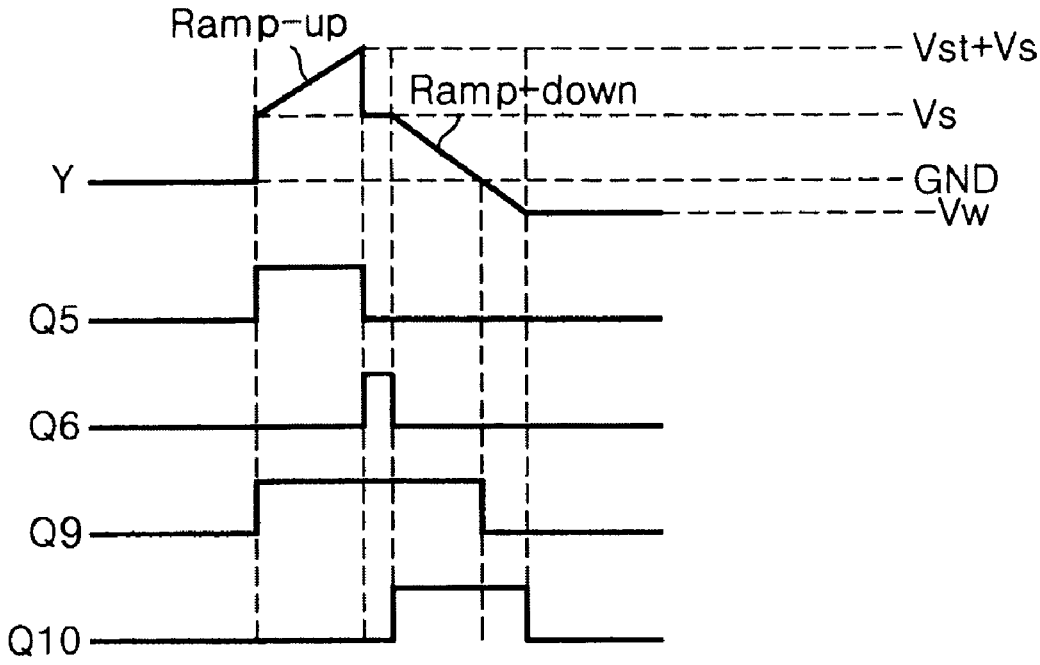
FIG. 14 shows timing diagrams of switches in a scan drive device of FIG. 13 for generating rising ramp wave form and falling ramp wave form during the reset period.

FIG. 14 shows timing diagrams of switches in a scan drive device of FIG. 13 for generating rising ramp wave form and falling ramp wave form during the reset period.

As shown in FIG. 14, the sixth switch Q6 is turned off and the tenth switch Q10 is turned on during the set down period. And, during a part of the set down period, that is, until the voltage of the fourth node n4 is greater than or equal to about ground voltage, the ninth switch Q9 remains to be turned on. This is controlled by the timing controller which is not shown in FIG. 10. And, during the set down period, the energy recovery circuit 60 does not supply the voltage Vs.

The tenth switch Q10 decreases the voltage of the fourth node n4 to the writing scan voltage Vw (or the set down voltage) with a slope by a variable resistor which is installed at the front side of the tenth switch Q10. Therefore, the voltage of falling ramp wave form (Ramp-down) is supplied to the scan electrode line (Y1, . . . , Ym). Here, because the ninth switch Q9 remains to be turned on, the voltage of the third node n3 is equal to the voltage of the fourth node n4.

Then, when the voltage of the fourth node n4 becomes about ground voltage, the timing controller turns the ninth switch Q9 off. Therefore, the voltage of the third node n3 remains to be ground voltage and the voltage of the second node n2 falls to the writing scan voltage Vw (or the set down voltage).

Actually, the set up supply part 62 and the set down supply part 67 supply the voltage of rising ramp wave form (Ramp-up) and the voltage of falling ramp wave form (Ramp-down)

to the scan electrode line (Y1, . . . , Ym) during the reset period by repeating this process. On the other hand, the ninth switch Q9 can have small endurance voltage in the present invention. That is, as the maximum voltage difference between the voltage of the third node n3 and the voltage of the fourth node n4 during the reset period, the switch of small endurance voltage can be used for the ninth switch Q9 and, accordingly, the manufacturing cost can be reduced.

Figure 15:
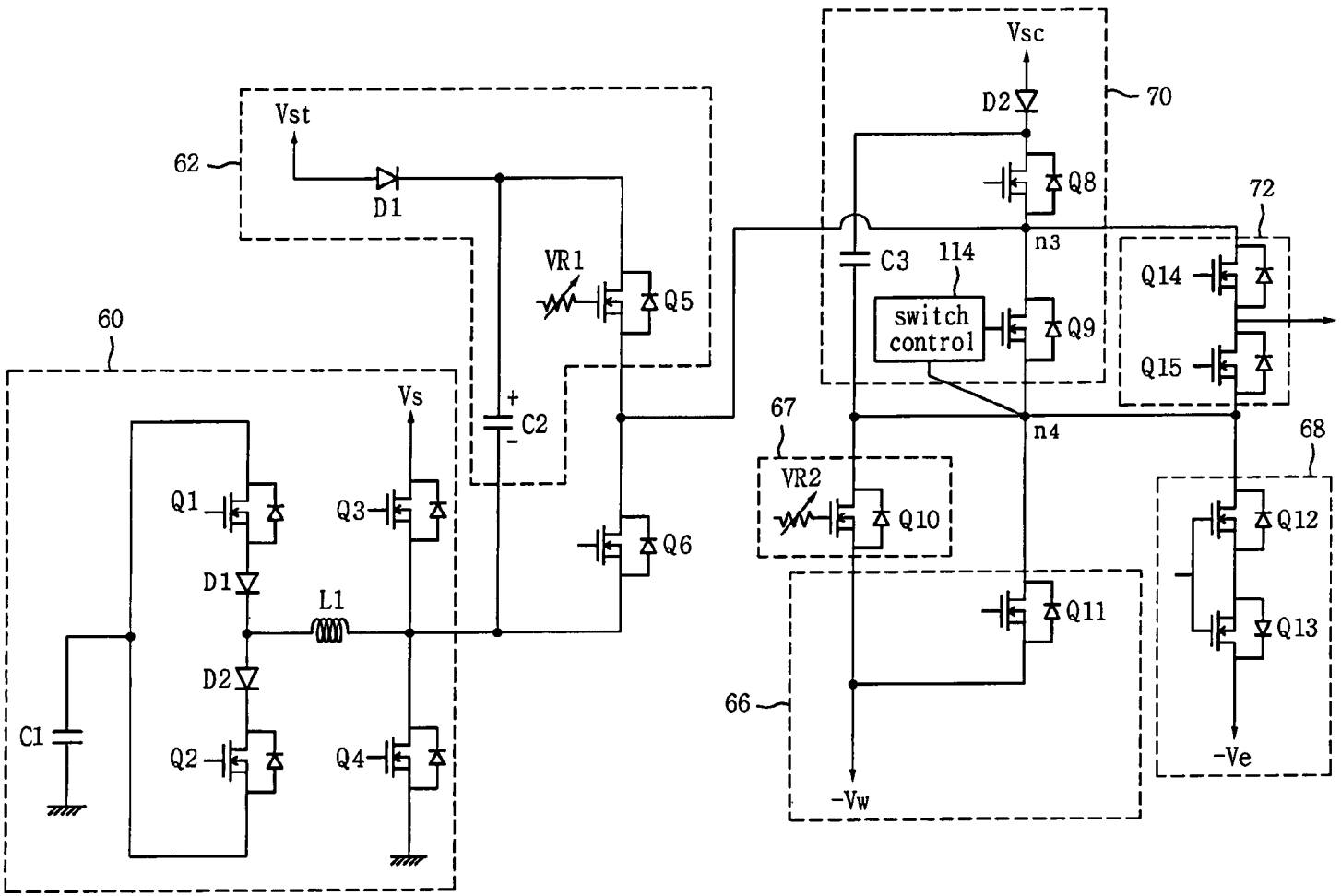
FIG. 15 shows a scan drive device of a plasma display panel in accordance with the modified second embodiment of the present invention.

FIG. 15 shows a scan drive device of a plasma display panel in accordance with the modified second embodiment of the present invention.

As shown in FIG. 15, a scan drive device of a plasma display panel in accordance with the modified first embodiment of the present invention includes further a switch control part 114 for controlling the ninth switch Q9 than the scan drive device which is shown in FIG. 10.

The operating and comprising of the switch control part 114 are same to those of the switch control part 64 of FIG. 12 in the first embodiment.

Figure 16:
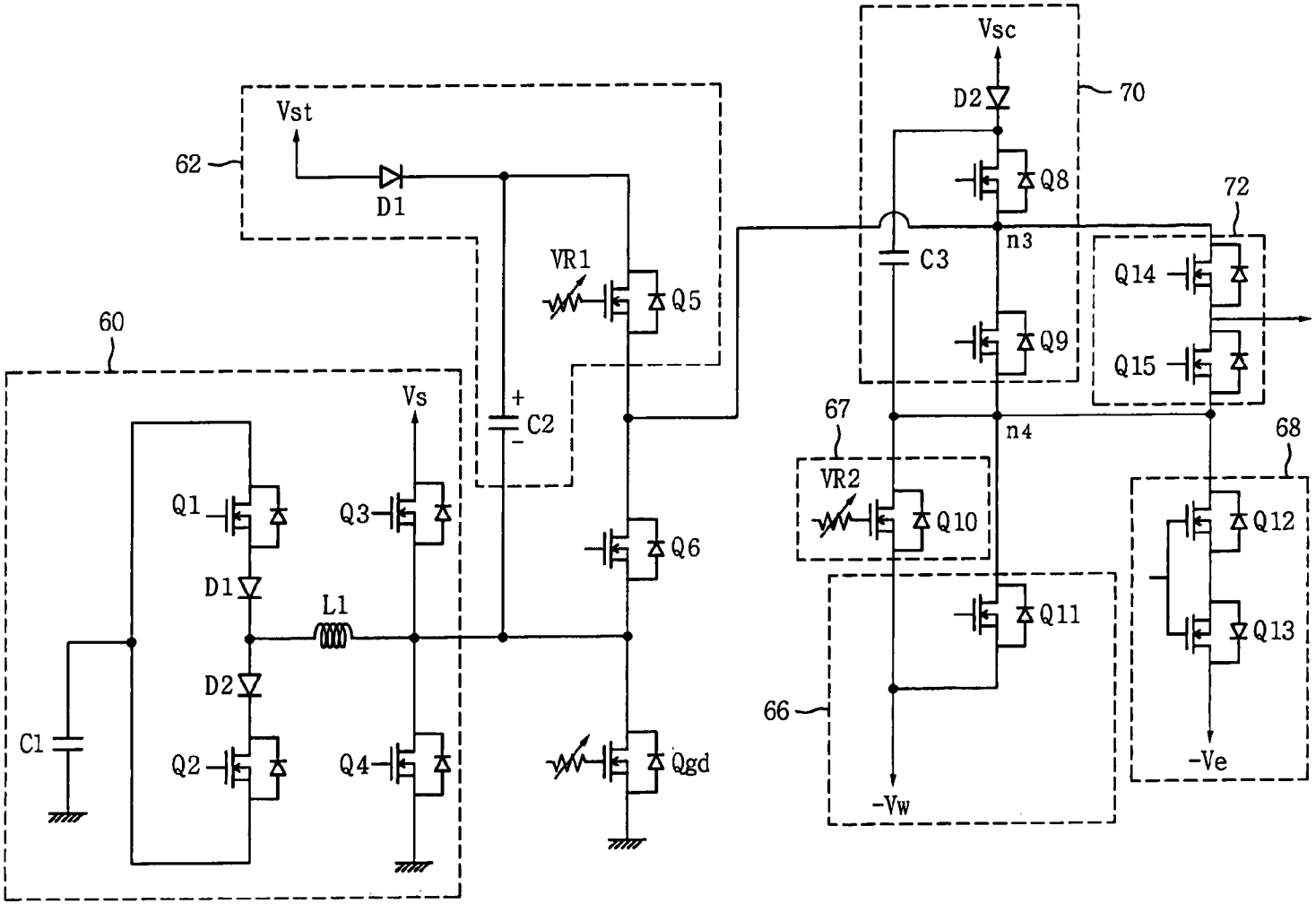
FIG. 16 shows a scan drive device of a plasma display panel in accordance with another modified first embodiment of the present invention.

FIG. 16 shows a scan drive device of a plasma display panel in accordance with another modified first embodiment of the present invention.

As shown in FIG. 16, a scan drive device of a plasma display panel in accordance with another modified first embodiment of the present invention includes further a ground switch Qgd which connects one terminal of the sixth switch Q6, which connects the energy recovery circuit 60 to the set up supply part 62, to ground voltage.

Figure 17:
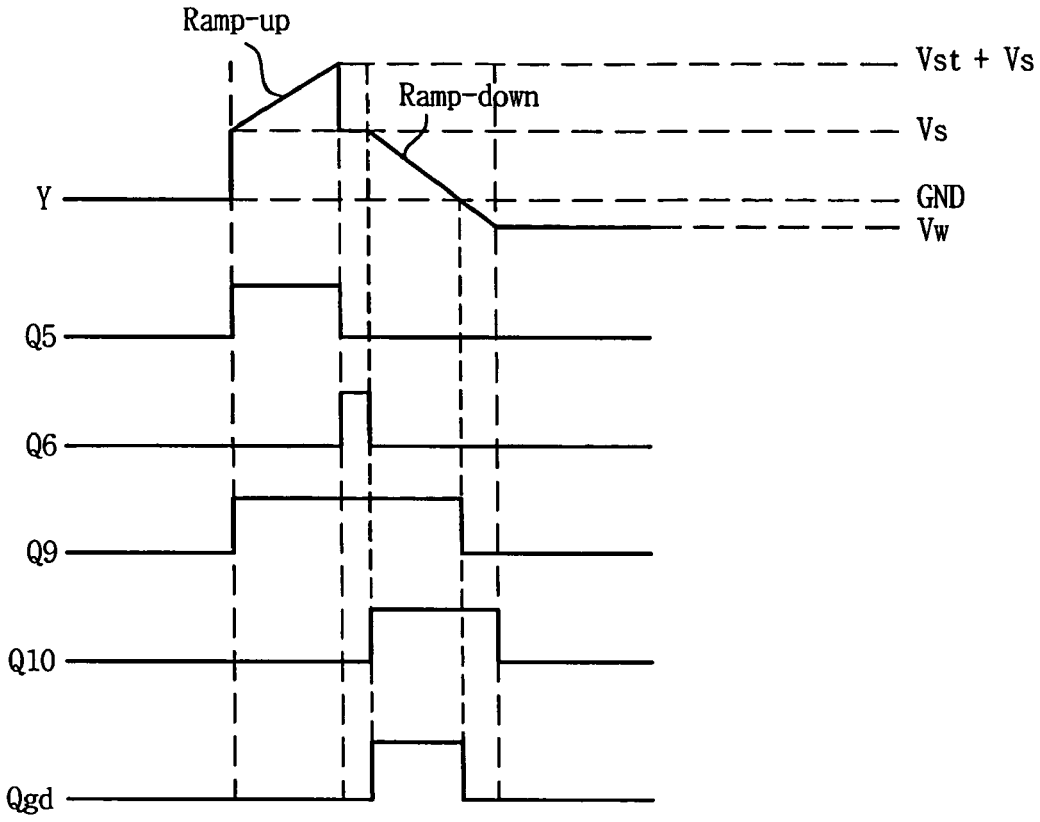
FIG. 17 shows timing diagrams of switches in a scan drive device of FIG. 16 for generating rising ramp wave form and falling ramp wave form during the reset period.

FIG. 17 shows timing diagrams of switches in a scan drive device of FIG. 16 for generating rising ramp wave form and falling ramp wave form during the reset period.

As shown in FIG. 17, the ground switch Qgd is turned on while remaining the ninth switch Q9 to be turned on in the period of the falling ramp wave form. If the ground switch Qgd is turned on, the voltage of the third node n3, that is one terminal of the ninth switch Q9, becomes ground voltage. Therefore, the endurance voltage of the seventh switch can be reduced strictly.

Figure 18:
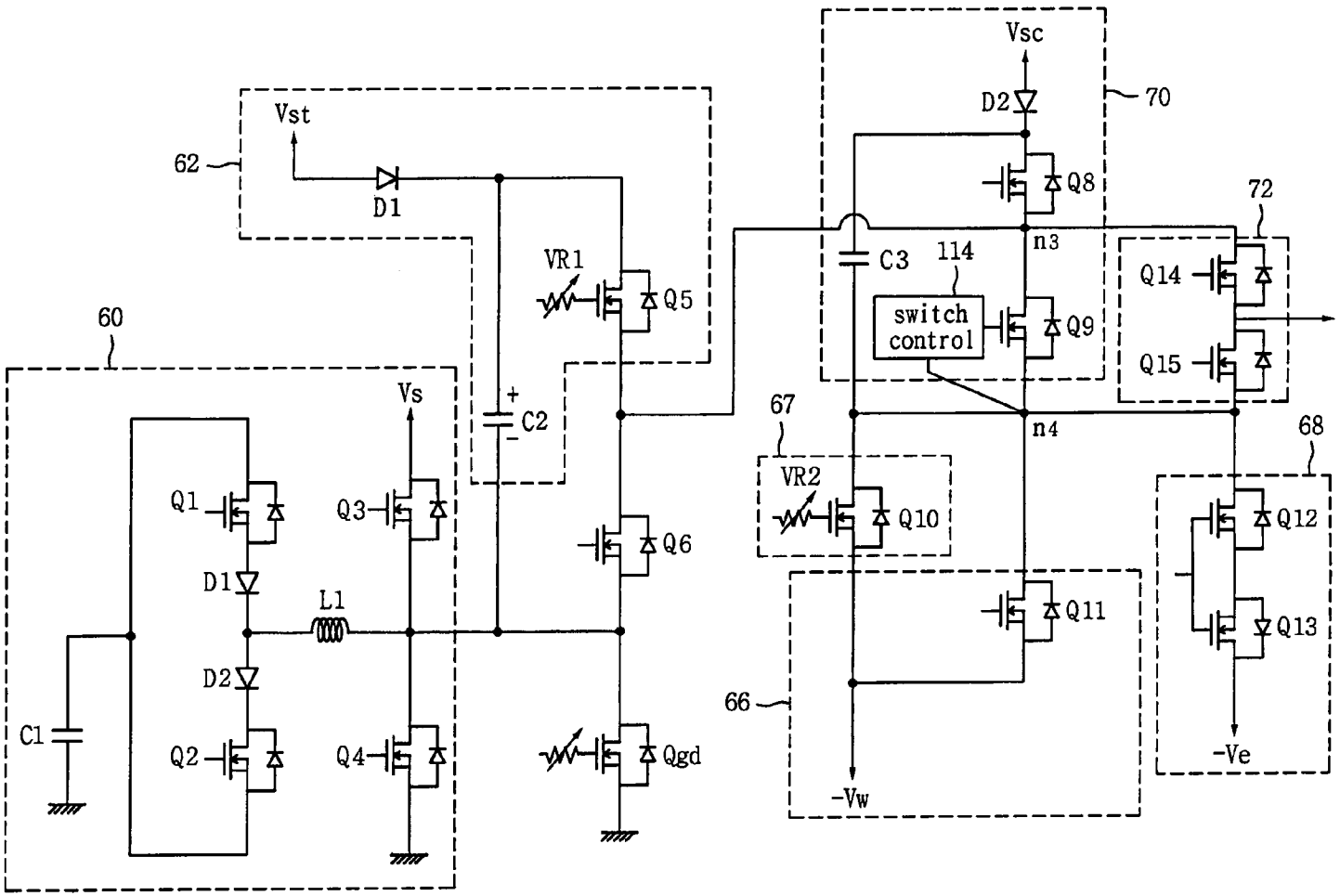
FIG. 18 shows a scan drive device of a plasma display panel in accordance with another modified second embodiment of the present invention.

FIG. 18 shows a scan drive device of a plasma display panel in accordance with another modified second embodiment of the present invention.

As shown in FIG. 18, the addition of the ground switch Qgd can be applied to the scan drive device of FIG. 15. The operating process of this case is same to that of FIG. 17.

As described hereinabove, the present invention provides a plasma display panel and a drive method thereof in which the manufacturing cost is reduced.

Further, the present invention provides a plasma display panel in which the number of switch device and the loss of energy are reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel having a drive device comprising:

a IC circuit supplying a drive voltage to scan electrodes;

a energy recovery circuit supplying a sustain voltage to the IC circuit;

a set up supply part supplying a rising ramp wave form to the IC circuit during a set up period; and a set down supply part supplying a falling ramp wave form to the IC circuit during set down period, wherein said drive device includes a switch that connects the set up supply part to the set down supply part and the switch is turned on or off responding to voltage supplied to the IC circuit during the set down period, wherein said switch is turned on during the set up period and a part of the set down period.

2. The plasma display panel of claim 1, wherein said switch is turned off right before the voltage supplied to the IC circuit becomes a ground voltage during the set down period.

3. The plasma display panel of claim 1, wherein said switch is turned on or off in order that a maximum value of a voltage difference between both terminals of the switch becomes the difference between a ground voltage and a minimum voltage of the falling ramp wave form.

4. The plasma display panel of claim 1, wherein said drive device further includes a switch control part that turns the switch on or off responding to the voltage supplied to the IC circuit during the set down period.

5. The plasma display panel of claim 4, wherein said switch control part turns the switch on during the set up period and the part of the set down period.

6. The plasma display panel of claim 5, wherein said switch control part turns the switch off right before the voltage supplied to the IC circuit becomes a ground voltage during the set down period.

7. The plasma display panel of claim 4, wherein said switch control part turns the switch on or off in order that a maximum value of a voltage difference between both terminals of the switch becomes the difference between a ground voltage and a minimum voltage of the falling ramp wave form.

8. The plasma display panel of claim 4, wherein said switch control part includes resistors for distributing voltage, which include more than at least two in order to sense the voltage supplied to the IC circuit, and a comparative device for controlling the switch by a voltage value distributed by the resistors for distributing voltage, and about a ground voltage.

9. The plasma display panel of claim 8, wherein said comparative device turns the switch on when the input voltage from the resistors for distributing voltage is greater than or equal to the ground voltage and turns the switch off when the input voltage from the resistors for distributing voltage is less than the ground voltage.

10. The plasma display panel of claim 1, wherein said drive device includes a ground voltage supply part that supplies the falling ramp wave form to a terminal of the switch during the part of the set down period.

11. The plasma display panel of claim 10, wherein said ground voltage supply part includes a variable resistance switch that is turned on at a starting time of the set down period and is turned off right before the voltage supplied to the IC circuit becomes a ground voltage.

12. The plasma display panel of claim 10, wherein said falling ramp wave form has a same slope or a different slope in the period to a ground voltage and in the period from the ground voltage to a minimum voltage.

13. A drive method of plasma display panel using a drive device that includes a IC circuit supplying a drive voltage to scan electrodes, an energy recovery circuit supplying a sustain voltage to the IC circuit, a set up supply part supplying a rising ramp wave form to the IC circuit during a set up period, and a set down supply part supplying a falling ramp wave form to the IC circuit during a set down period, wherein the drive method comprises:

the set up supply part supplying a rising ramp wave form to the scan electrodes during the set up period, the set down supply part supplying a falling ramp wave form to the scan electrodes during the set down period, and turning the switch, which connects the set up supply part to the set down supply part, on or off responding to the voltage supplied to the scan electrodes during the set up period and set down period, wherein said switch is turned on during the set up period and a part of the set down period.

14. The plasma display panel of claim 13, wherein said switch is turned off when the voltage of the falling ramp wave form becomes less than about a ground voltage.

* * * * *